United States Patent [19]

Powell

[11] 4,221,447

[45] Sep. 9, 1980

[54] ELECTRICAL CONNECTOR

[75] Inventor: Lloyd J. Powell, Newmarket, Canada

[73] Assignee: International Telephone and Telegraph Corporation, New York, N.Y.

[21] Appl. No.: 14,961

[22] Filed: Feb. 26, 1979

Related U.S. Application Data

[63] Continuation-in-part of Ser. No. 916,111, Jun. 16, 1978, abandoned.

[51] Int. Cl.[3] ..... H01R 12/13

[52] U.S. Cl. ..... 339/64 M; 339/136 M; 339/256 R; 339/275 R

[58] Field of Search ..... 339/64 R, 64 M, 89 R, 339/89 M, 191 M, 192 R, 255 R, 255 RT, 256 R, 257, 258 R, 258 P, 258 RR, 262 R, 262 RR; 339/136 M, 275 R

[56] References Cited

U.S. PATENT DOCUMENTS

| | | | |
|---|---|---|---|
| 2,231,124 | 2/1941 | Joseph | 339/89 M |
| 2,695,390 | 11/1954 | Woolston et al. | 339/258 RR |
| 3,097,905 | 7/1963 | Shearer et al. | 339/186 M |
| 3,384,866 | 5/1968 | Nava | 339/256 R |
| 3,654,595 | 4/1972 | Curr | 339/256 R |
| 3,763,460 | 10/1973 | Hatschek et al. | 339/258 R |
| 3,860,315 | 1/1975 | Tetreault et al. | 339/89 M |

FOREIGN PATENT DOCUMENTS

| | | | |
|---|---|---|---|
| 973130 | 2/1951 | France | 339/89 M |
| 1030424 | 5/1966 | United Kingdom | 339/256 R |

*Primary Examiner*—Neil Abrams
*Attorney, Agent, or Firm*—Thomas L. Peterson

[57] ABSTRACT

A high temperature hermetic electrical connector is disclosed in which socket contacts are hermetically sealed in a rear insulator of one connector member. A "napkin" spring is mounted on a forward portion of the body of each socket contact which extends forwardly of the rear insulator. A front insulator is removably mounted on the front face of the rear insulator, and serves to retain the "napkin" springs on the socket contact bodies. When the front insulator is removed, a damaged "napkin" spring may be replaced in the field by a new spring without affecting the sealing integrity of the connector. In a second embodiment, a metal hood slidably mounted on a contact body removably retains the "napkin" spring thereon.

12 Claims, 7 Drawing Figures

ELECTRICAL CONNECTOR

CROSS-REFERENCE TO RELATED APPLICATION

This is a continuation-in-part of my copending application Ser. No. 916,111, filed June 16, 1978 now abandoned.

BACKGROUND OF THE INVENTION

The present invention relates generally to an electrical connector and, more particularly, to a high temperature hermetic electrical connector of the type which may be used in hostile environments.

A standard socket contact utilized in the connector industry comprises a tubular member which has a pair of opposed longitudinal slots therein opening at one end thereof, defining a pair of longitudinally extending spring fingers. The spring fingers function as spring beams which resiliently engage a pin contact inserted into the socket contact. Such a contact is disclosed in U.S. Pat. No. 3,564,487. The contact is not suitable for use in hermetic connectors in which the contact body is sealed into the insulator of the connector by the use of heat, such as by using a glass ring seal or by brazing, because the heat used in the sealing process anneals the spring beams causing them to lose their resilience. Thus, in a hermetic connector in which heat is used to form the seal of the contact body in the insulator, it is necessary to utilize a separate spring member which is mounted on the contact body after the body is sealed in the insulator. Normally, the spring member of the socket contact has been permanently applied to the sealed socket contact body by crimping, welding, etc. If the spring member becomes damaged during use of the connector, it cannot be removed from the contact body for replacement without distorting the sealed contact body and, therefore, damaging the hermeticity of the connector.

Therefore, what is needed in the industry, and which constitutes the purpose of the present invention, is a hermetic electrical connector in which the spring members of the socket contacts may be removed from the sealed contact bodies without damaging the seals so that damaged socket contact springs may be replaced in the field without impairing the sealing integrity of the connector. While the present invention will be described specifically with respect to a hermetic connector, it will be appreciated from the following description that the invention may also be applied to electrical connectors in which the contacts are not hermetically sealed in the insulators in the connectors.

SUMMARY OF THE INVENTION

According to the principal aspect of the present invention, there is provided an electrical connector including an insulator having a bore extending from a front face to a rear face thereof. A socket contact body is mounted in the bore. The socket contact body embodies a forward portion which extends forwardly of the front face of the insulator. A pin contact-receiving spring sleeve is removably mounted on the forward portion of the contact body. Means removably mounted over the forward portion of the contact body serves to retain the spring sleeve thereon. The spring sleeve may be removed, for replacement if damaged, from the contact body when said retaining means is removed from the forward portion of the contact body.

Thus, by the present invention, the socket contact body may be hermetically sealed by the use of heat in the insulator, and the spring member of the socket contact may be replaced without distorting the sealed contact body and, thus, impairing the hermeticity of the connector.

DESCRIPTION OF THE PREFERRED EMBODIMENT

Figure 1:
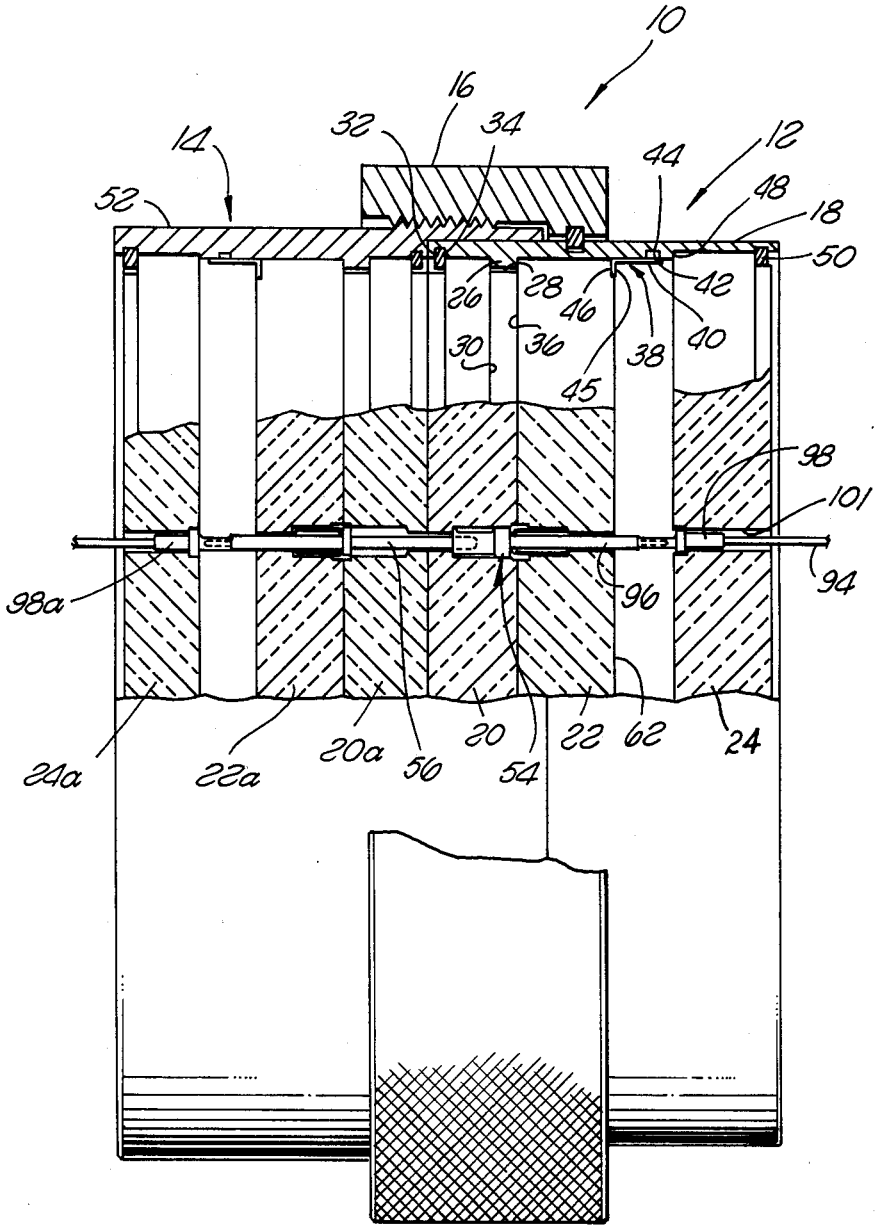
FIG. 1 is a partial longitudinal sectional view of one embodiment of the connector of the present invention showing one pair of pin and socket contacts mated.

Referring now to the drawings in detail, there is illustrated in FIG. 1 one embodiment of the connector of the present invention, generally designated 10. The connector comprises a a plug connector member 12 and a mating receptacle connector member 14. The two connector members are retained in mating relationship by a coupling ring 16 or other equivalent means.

The shell 18 of the plug connector member 12 contains a front insulator 20, a rear insulator 22, and an insulation disc 24 behind the rear insulator. Preferably, the insulators are formed of a ceramic, such as 94% to 96% aluminum oxide. The shell 18 embodies an inwardly extending annular flange 26. A peripheral annular groove 28 is formed at the rear of the front insulator defining a rearwardly facing annular shoulder 30. The shoulder 30 abuts against the flange 26. The front insulator is removably mounted in the shell 18 by a snap ring 32 which is fitted in an annular groove 34 adjacent to the forward end of the shell. The front face 36 of the rear insulator abuts the flange 26 and engages the rear surface of the front insulator. Alternately, annular flange 26 may be positioned behind the rear face of the rear insulator 22 depending on the direction (i.e., internal or external) of any pressurized or other mechanical loading requirements. The location of the various annular insulator shoulders would be altered to accommodate the flange in this position.

Preferably, the rear insulator 22 is sealed by a hermetic seal to the shell 18. Such seal is provided by means of a metal ring, generally designated 38, having a cylindrical portion 40 which is sealed to the shell by means of a brazing ring 42 disposed in a groove 44 in the inner surface of the shell 18. The ring 38 embodies an inwardly extending annular flange 45 which is sealed to the rear peripheral face of the rear insulator by an annular ring of brazing material 46.

A rearwardly facing annular shoulder 48 is formed on the inside of the shell 18 behind the metal sealing ring 38. The insulator disc 24 engages the shoulder 48 and is removably retained in the shell by means of a snap ring 50.

The barrel 52 of the receptacle connector member 14 contains a front insulator 20*a*, rear insulator 22*a*, and insulator disc 24*a*, which are identical to the parts 20, 22, and 24 of the plug connector member, and are mounted in the barrel in exactly the same manner as described previously in connection with the plug connector member.

A plurality of socket contacts, generally designated 54, are mounted in the plug connector member 12 and are adapted to mate with a plurality of pin contacts 56 mounted in the receptacle connector member, only one pair of such pin and socket contacts being illustrated in the drawings.

Figure 2:
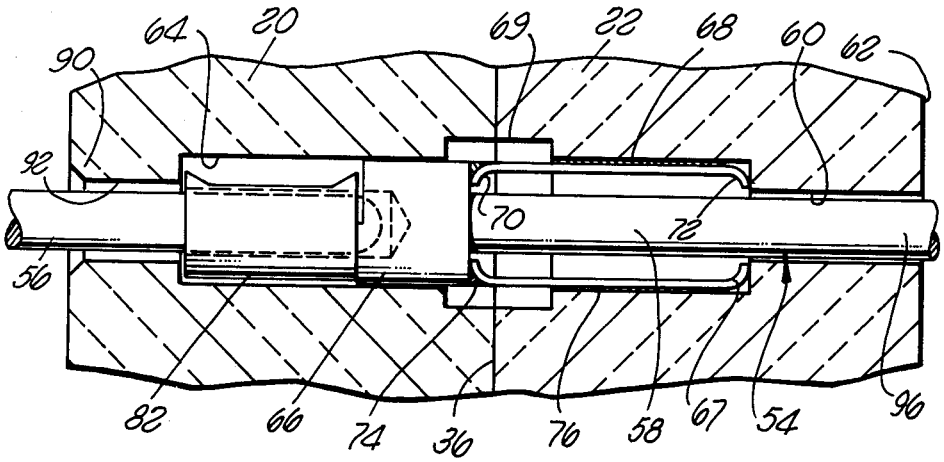
FIG. 2 is an enlarged, fragmentary longitudinal sectional view showing the details of structure of the mating pin and socket contacts of the connector illustrated in FIG. 1.

As best seen in FIG. 2, the socket contact 54 has a cylindrical contact body 58 mounted in a cylindrical bore 60 which extends from the front face 36 of the rear insulator to the rear face 62 thereof. A cylindrical passage 64 is provided in the front insulator 20 coaxial with the bore 60. The contact body 58 embodies an enlarged cylindrical portion 66 which extends forwardly of the front face 36 into the passage 64 in the front insulator. A flexible metal eyelet or sleeve 67 is mounted in an enlarged section 68 of the bore 60 which opens to the front face 36 of the rear insulator and is counterbored as indicated at 69. The eyelet surrounds the cylindrical contact body 58. The eyelet embodies a front inwardly extending flange 70 and a rear inwardly extending flange 72. The front flange 70 is brazed to the rear surface of the enlarged portion 66 of the contact body, as indicated at 74. The portion of the eyelet within the bore 68 is sealed to the wall of the bore by brazing, as indicated at 76. The brazed joints 74, 76 to provide a hermetic seal between the socket contact and the rear insulator. A seen in FIG. 2, the cylindrical contact body of the socket contact has a loose fit in the bore 60 in the rear insulator. Because the eyelet 76 is fixed at one end to the contact body and is fixed at an axially displaced rearward portion thereof to the rear insulator 22, and the eyelet is formed of a flexible metal, the socket contact body is capable of a small degree of flexure, while the sealing integrity of the contact in the insulator is retained, so that this mounting structure accommodates for possible misalignment between the pin and socket contacts when the connector members 12 and 14 are mated.

Figure 4:
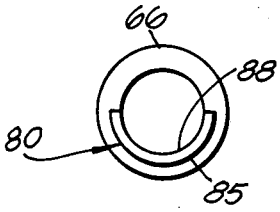
FIG. 4 is a front end view of the socket contact body illustrated in FIG. 3.
Figure 3:
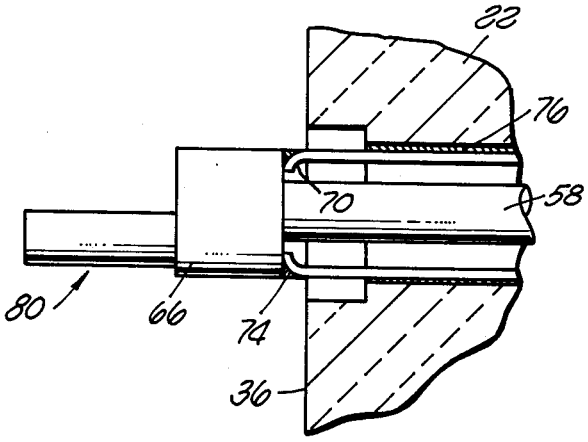
FIG. 3 is an enlarged fragmentary partial longitudinal sectional view through the rear insulator of the plug connector member illustrated in FIG. 1 showing the "napkin" spring sleeve of the socket contact removed from the socket contact body.
Figure 5:
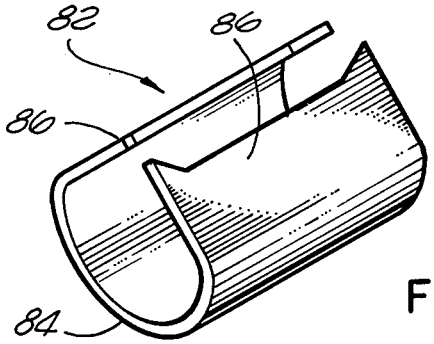
FIG. 5 is an enlarged perspective view of the "napkin" spring sleeve of the socket contact.
Figure 6:
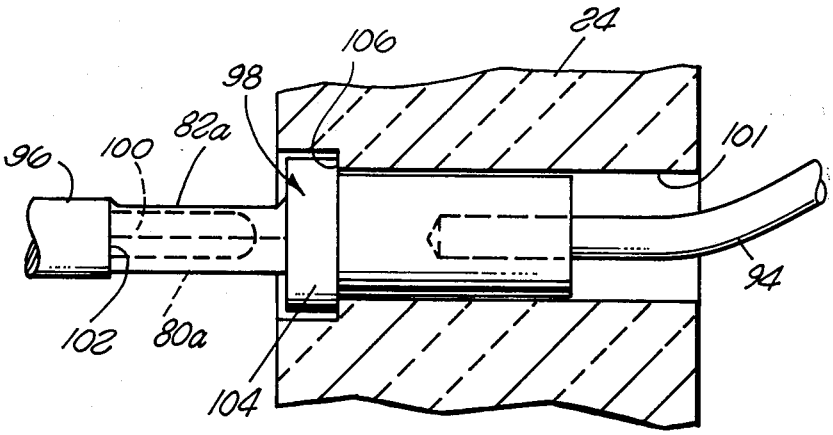
FIG. 6 is an enlarged fragmentary partial longitudinal sectional view showing a second socket contact mounted in an insulator disc used in the connector of FIG. 1 and mated with a rear pin contacting portion of the first socket contact.

As best seen in FIGS. 3 and 4, the socket contact body 58 embodies a semi-cylindrical forward portion 80 which extends forwardly from the enlarged portion 66 of the body coaxial with the center axis thereof. A spring sleeve, as shown in FIG. 5, generally designated 82, is mounted on the forward semi-cylindrical portion 80 of the contact body, as seen in FIG. 2. The spring sleeve 82 may be in the form of a conventional "napkin" spring which has been used previously in the art. The spring sleeve embodies a first semi-cylindrical section 84 which is complementary to and embraces the curved outer surface 85 of the forward portion 80 of the contact body. The sleeve 82 also embodies a pair of inwardly extending spring sections 86 which extend over the inner curved surface 88 of the forward portion 80 of the socket contact. The curved inner surface 88 of the socket contact body is complementary to the cylindrical pin contact 56. When the pin contact is mated with the socket contact, the spring sections 86 of the spring sleeve 82 expand outwardly and thus exert a resilient spring force upon the pin contact, urging it into intimate engagement with the curved inner surface 88 of the socket contact. The spring sections 86 of the "napkin" spring are preset so as to produce a predetermined retention force between the pin contact 56 and the forward portion 80 of the socket contact body 58.

In contrast to a conventional socket contact utilizing a "napkin" spring in which a fixed ring is formed on the contact body in front of the "napkin" spring to retain the spring on the contact body, the socket contact 54 of the present invention eliminates such ring so that the spring sleeve 82 may be slid longitudinally onto the forward portion of the socket contact. As seen in FIG. 2, an annular flange 90 extends inwardly from the wall of the passage 64 in front of the spring sleeve 82. The pin contact 56 extends through an axial bore 92 in the flange. The flange provides a closed entry which protects the spring sleeve 82 against damage which might otherwise occur due to mismating the contacts or insertion of testing probes into the connector. Further, the flange 90 removably retains the spring sleeve 82 on the socket contact body. That is to say, the spring sleeve 82 may be removed from the contact body by releasing the snap ring 34 and removing the front insulator from the rear insulator of the connector, whereupon the spring sleeve may be simply slid off the forward portion 80 of the socket body. Thus, the socket contact spring sleeve is field replaceable without affecting the sealing integrity of the socket contact body mounted in the rear insulator. The removable spring sleeve arrangement 82 for the socket contact has a further advantage in that it permits selected spring sleeves to be removed from the socket contact bodies in the plug connector member where a fewer number of electrical paths are required through the connector than there are contacts in order to minimize the mating forces between the plug and receptacle members while still maintaining hermeticity within the connector. In addition, the spring retention forces of individual spring sleeves 82 may be varied to suit critical electrical paths requiring increased vibration resistance, thermal creep resistance, etc.

The conductor 94 for each socket contact, illustrated in FIG. 1, may be directly connected to the rear portion 96 of the socket contact body which extends from the rear face 62 of the rear insulator by wire-wrapping, brazing, etc. However, in accordance with the invention, preferably a "push-on" contact approach is used which allows a plurality of conductors to be electrically connected to the socket contacts in the connector simultaneously. To this end, a socket contact 98 is mounted in a cylindrical bore 101 coaxial with a respective cylindrical bore 60 in the rear insulator. The rear of the socket contact 98 may be crimped onto the conductor 94. The forward mating end of socket contact 98 may be identical to the socket contact 54 and thus comprises a spring sleeve 82*a* mounted on a forward portion 80*a* of the contact. The rear contacting portion 96 of socket contact 54 is in the form of a pin contact similar to the contact 56 except that the terminal end 100 thereof has a reduced diameter defining a rearwardly facing annular shoulder 102. The terminal end 100 mates with the socket contact 98 in the same manner that the pin contact 56 and socket contact 54 mate, as explained previously herein, and the shoulder 102 removably retains sleeve 82*a* on the forward portion 80*a* of the contact. An enlarged portion 104 of the contact body of the socket contact 98 engages a forwardly facing shoulder 106 in the insulator disc 24 surrounding the opening 101 for restraining rearwaerd movement of the socket contact in the disc.

It will be appreciated from the foregoing that the disc 24 will contain a like number of socket contacts 98 as the socket contacts 54. The disc serves to properly position and hold the socket contacts 98 so that they may be pushed individually or simultaneously onto the rear pin contacting portions 96 of the socket contacts 54 mounted in the rear insulator 22. The insulation disc mounting for the socket contacts 98 also assures that such contacts will be maintained in good electrical engagement with the socket contacts 54 even under high vibration conditions.

It will be noted that the socket contacts 98 are not sealed in the insulator disc 24. Consequently, after removing the disc 24 from the shell 18, each individual contact 98 may be pulled forwardly out of the disc; and if necessary, a damanged spring sleeve 82*a* can be removed from the socket contact body. As with the contacts 54, the spring sleeves 82*a* on the socket contacts 98 may be readily removed by sliding the sleeves axially off the contact bodies.

The pin contacts 56 in the receptacle connector member 14 may be hermetically sealed into the rear insulator 22*a* in the same manner that the socket contacts 54 are mounted in the rear insulator 22 of the plug connector member. Also, the insulator disc 24*a* may contain socket contacts 98*a* identical to the contacts 98 in the disc 24. Thus, the connector members 12 and 14 differ only in the construction of the mating socket and pin contacts 54 and 56, respectively. Although the front and rear insulators 20, 22, 20*a* and 22*a* referred to herein have been disclosed as being formed of a ceramic material and the contacts are hermetically sealed to the ceramic material by brazing, it will be appreciated that the contacts could be hermetically sealed into other forms of insulators by different sealing techniques. For example, the insulators may be formed of plastic; in which case, the contacts may be sealed therein by means of a suitable epoxy resin. Further, the contacts could be sealed by glass ring seals in metal plates; in which case, the glass ring seals would provide the insulation mounting for the contacts. While the advantages of the present invention are achieved to the greatest extent in a hermetically sealed connector, it will be appreciated that the novel socket contacts of the invention with the front removable spring sleeves may be utilized in any connector, whether sealed or unsealed.

Figure 7:
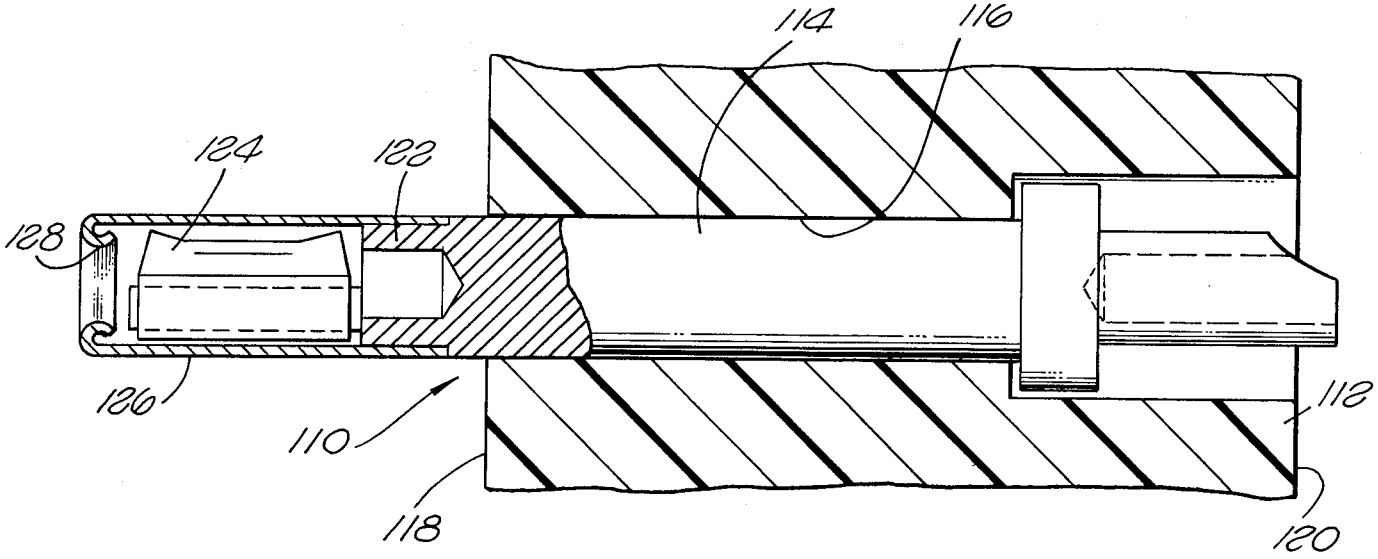
FIG. 7 is an enlarged fragmentary partial longitudinal sectional view through an alternative form of the socket contact of the present invention mounted in an insulator.

Reference is now made to FIG. 7 which illustrates an alternative form of the invention, wherein a socket contact 110 is mounted in a plastic insulator 112. The socket contact has a cylindrical body 114 mounted in a bore 116 extending from the front face 118 to the rear face 120 of the insulator 112. The contact body may be hermetically sealed in the insulator, if desired. The socket contact body embodies a forward portion 122 having a spring sleeve 124 slidably mounted thereon, equivalent to the forward portion 80 and spring sleeve 82 in the first embodiment of the invention disclosed herein. Rather than utilizing a second insulator in front of the insulator 112 to retain the spring sleeve 124 on the contact body, in this embodiment a metal, cylindrical hood 126 is slidably mounted on the forward portion 122 of the contact body behind the spring sleeve 124. The hood extends forwardly beyond the forward portion 122 of the contact body, and embodies an inwardly extending rolled-over lip 128 which provides a closed entry for the socket contact, and retains the spring sleeve 124 on the contact body. As in the first embodiment of the invention, the spring sleeve 124 may be removed if damaged, or if it is desired to replace the same with a sleeve of different size or spring characteristics, but in this case by removing the hood 126 rather than a front insulator. It is to be understood, however, that a removable front insulator could be used, if desired, to provide support for the front ends of the hoods, and thus avoid excessive bending of the contacts which could damage the hermetic seals of the contact bodies 114 in the insulator 120. Thus, it will be appreciated that this embodiment of the invention has all the advantages discussed hereinabove with respect to the first embodiment illustrated in FIGS. 1 to 6.

Referring again to FIG. 6, if desired, the contact 98 could be replaced by the hooded contact 110 illustrated in FIG. 7.

I claim:

1. An electrical connector member comprising:

a shell containing a front insulator and a rear insulator, said shell having a forward end and a rear;

said rear insulator having a bore extending from a front face to a rear face thereof;

said front insulator being removably mounted in said shell adjacent to the front face of said rear insulator and having a passage therethrough aligned with said bore;

releasable holding means adjacent to said forward end of said shell for holding said front insulator adjacent to said rear insulator, said holding means being movable relative to said shell to allow removal of said front insulator from said shell;

a socket contact including a contact body permanently mounted in said bore, said contact body embodying a forward portion extending forwardly of said front face into said passage, said forward portion having a longitudinally extending open curved channel therein adapted to slidably receive a mating pin contact;

pin contact-receiving spring sleeve means removably mounted on said forward portion of said contact body adapted to resiliently urge the pin contact against the wall of said channel, said spring sleeve means being loose relative to the wall of said passage surrounding said sleeve; and said front insulator embodying means for retaining said spring sleeve means on said forward portion of said contact body when said front insulator is mounted in said shell adjacent to said front face of said rear insulator, said spring sleeve means being longitudinally slidably removable from said contact body when said front insulator is removed from said shell.

2. An electrical connector as set forth in claim 1 including:

means hermetically sealing said contact body in said rear insulator.

3. An electrical connector as set forth in claim 2 including:

means hermetically sealing said rear insulator to said shell.

4. An electrical connector as set forth in claim 1 including:

flexible means mounting said contact body in said rear insulator to accommodate for any misalignment between said socket contact and a mating pin contact.

5. An electrical connector as set forth in claim 4 wherein:

said flexible mounting means hermetically seals said contact body in said rear insulator.

6. An electrical connector as set forth in claim 1 including:

an elongated flexible sleeve surrounding said contact body;

first means attaching one end of said sleeve to said rear insulator; and second means attaching the opposite end of said sleeve to said contact body.

7. An electrical connector as set forth in claim 6 wherein:

said first and second attaching means hermetically seal said flexible sleeve to said rear insulator and contact body, respectively.

8. An electrical connector as set forth in claim 1 wherein:

said retaining means comprises an annular flange extending inwardly from the wall of said passage in front of said spring sleeve means providing a closed entry for said socket contact.

9. An electrical connector as set forth in claim 1 including:

an insulator disc removably mounted in said shell behind said rear insulator having an opening therethrough aligned with said bore;

said socket contact having a rear pin contacting portion extending rearwardly of said rear face; and a second socket contact mounted in said opening and receiving said pin contacting portion of said first-mentioned socket contact.

10. An electrical connector member comprising:

an insulator having a bore extending from a front face to a rear face thereof;

a socket contact including a contact body permanently mounted in said bore, said contact body embodying a forward portion extending forwardly of said front face, said forward portion having a longitudinally extending open curved channel therein adapted to slidably receive a mating pin contact;

pin contact-receiving spring sleeve means longitudinally slidably mounted on said forward portion of said contact body adapted to resiliently urge the pin contact against the wall of said channel; and retention means separable from said spring sleeve means removably mounted over said forward portion of said contact body for retaining said spring sleeve means thereon, said spring sleeve means being longitudinally slidably removable from said contact body when said retention means is removed from said forward portion.

11. An electrical connector as set forth in claim 10 wherein:

said retaining means comprises a second insulator mounted on the front face of said first-mentioned insulator.

12. An electrical connector as set forth in claim 10 wherein:

said retaining means comprises a metal hood slidably mounted on said forward portion of said contact body.

* * * * *